US005863141A

United States Patent [19]

Hong et al.

[11] Patent Number: 5,863,141

[45] Date of Patent: Jan. 26, 1999

[54] IMAGE-RELATED DEVICE WITH PRINTED-CIRCUIT ASSEMBLY CANTILEVERED FROM SHEET-METAL BASE & WITH CLIP FASTENINGS

[75] Inventors: Juehui Hong, San Diego; John H. Harris, Murrieta; Susan Andersen, Carlsbad; Chris P. Johnson, San Diego, all of Calif.

[73] Assignee: Hewlett-Packard Company, Palo Alto, Calif.

[21] Appl. No.: 844,140

[22] Filed: Apr. 18, 1997

Related U.S. Application Data

[63] Continuation-in-part of Ser. No. 684,736, Jul. 22, 1996, Pat. No. 5,775,825.

[51] Int. Cl.[6] ..... B41J 29/02

[52] U.S. Cl. ..... 400/692; 400/693; 361/753; 361/759

[58] Field of Search ..... 400/691, 692, 400/693; 361/748, 752, 753, 756, 757, 759

[56] References Cited

U.S. PATENT DOCUMENTS

| | | | |
|---|---|---|---|
| 4,459,640 | 7/1984 | Latasiewicz et al. | 361/753 |
| 4,739,452 | 4/1988 | Fukunaga | 361/753 |
| 5,122,005 | 6/1992 | Kamei | 400/691 |
| 5,152,624 | 10/1992 | Buschmann et al. | 400/691 |
| 5,398,156 | 3/1995 | Steffers et al. | 361/753 |
| 5,404,274 | 4/1995 | Bond et al. | 361/759 |
| 5,408,207 | 4/1995 | Chanteau | 361/753 |
| 5,644,474 | 7/1997 | Jang | 361/753 |

*Primary Examiner*—Christopher A. Bennett

[57] ABSTRACT

In a mounting system for an assembly in a high-frequency desktop device, a chassis element ("element") provides ground. For best ground, features formed in the element near a first edge of the assembly force the two together with no fastener there. Fasteners or other provisions secure the assembly, near its second edge, to the element. The features capture the first edge at installation; the fasteners etc. secure the assembly, near its second edge so that the features pinch the first. In another form of the system (1) first raised shapes formed in the element support the assembly near its first edge; (2) features, also formed in the element next to the first shapes, engage and capture the first edge; (3) second raised shapes, formed in the element, support the assembly near its second edge; and (4) fasteners etc. secure the assembly, near its second edge. Preferably the features are so spaced above the first raised shapes as to slightly flex the assembly; no separate fastener holds the assembly to the element near the first raised shapes; the first or second shapes, or both, are metallic and engage grounding pads; and the element is formed metal, structurally integrated with other chassis and case pieces. In another form, the invention is an entire image-related device including the stated items. A method installs and removes the assembly with just one-side access: inserting its first edge between the retainers and first raised shapes, rotating it to operating position to engage it with the second raised shapes near a second edge and pinch the first edge between the retainers and first raised shapes, and securing it—or reversing the steps to remove it.

28 Claims, 11 Drawing Sheets

10'
18'
14
18
16
17
10
15
12
15'
11

20
21
22
22'
24
25
25'
26
27
28
28'
-28'-

FIG. 35
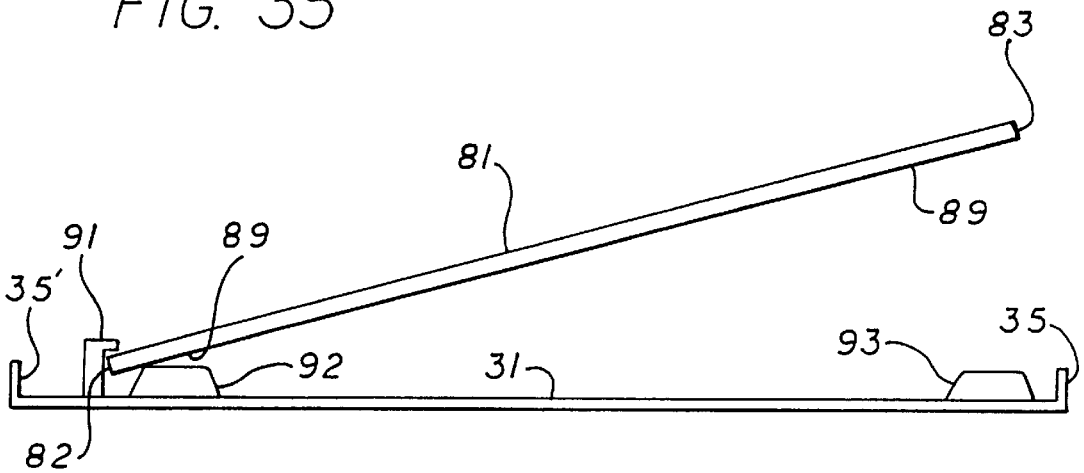
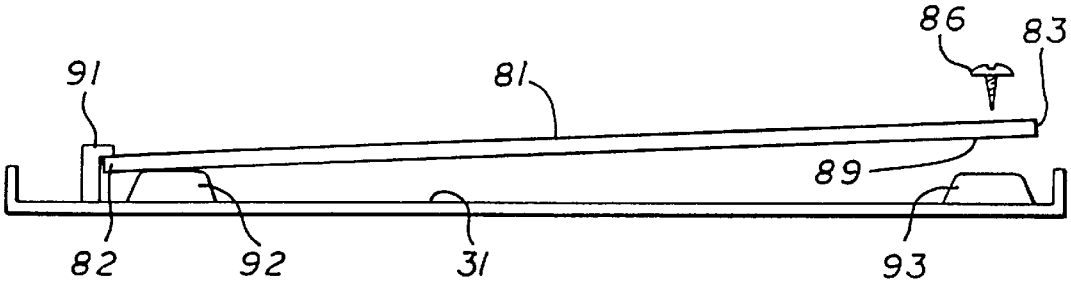
FIG. 36
FIG. 37
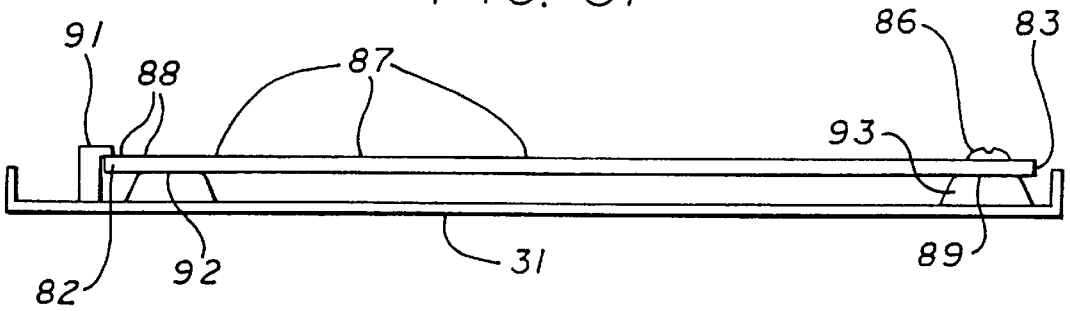

FIG. 39
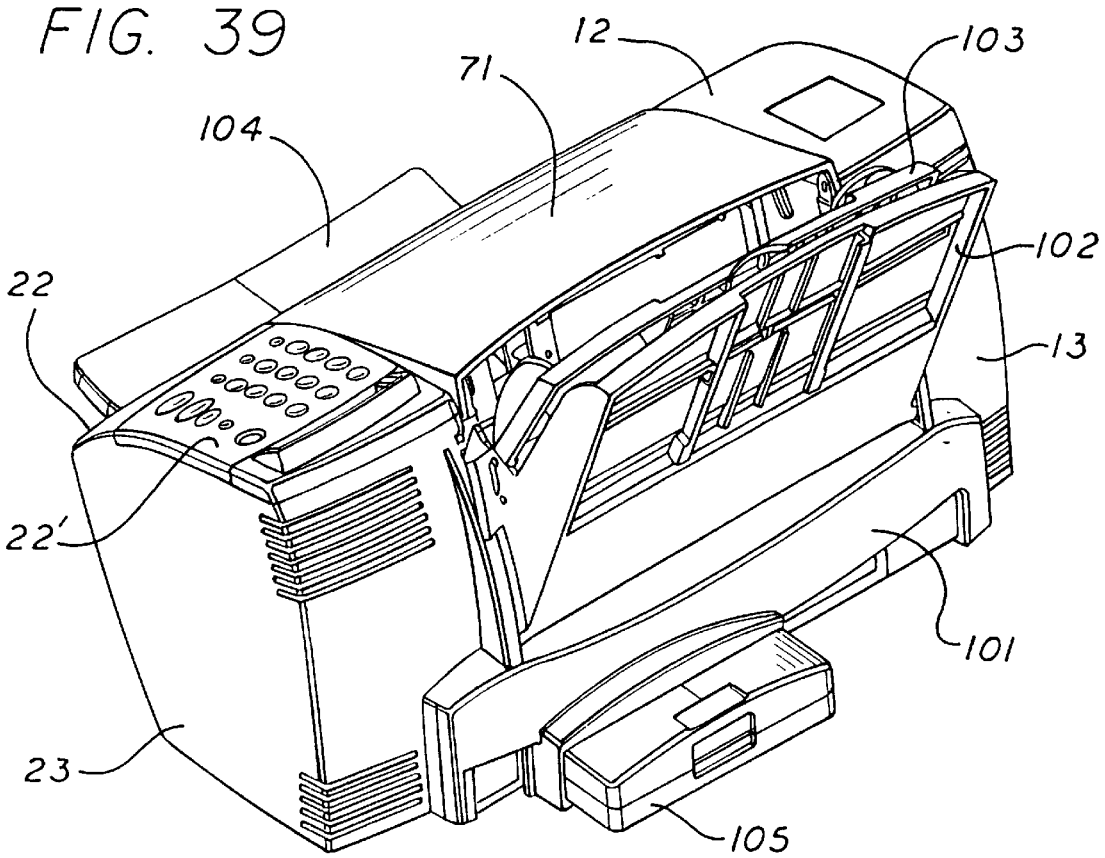
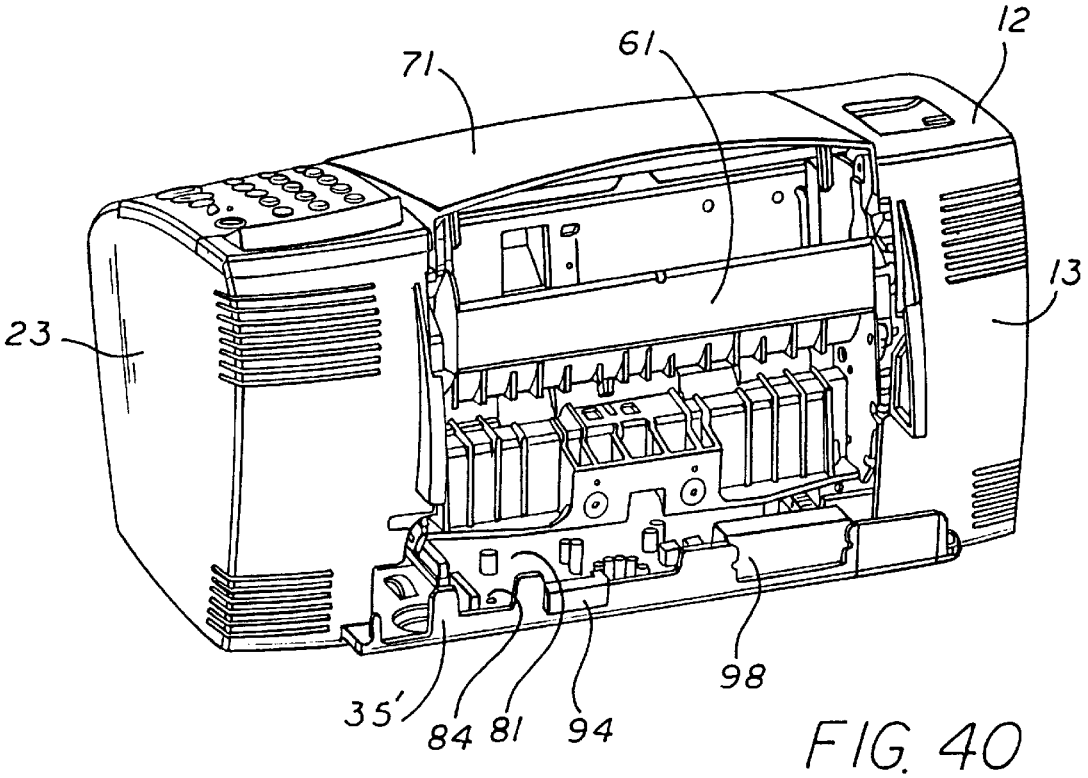
FIG. 40

IMAGE-RELATED DEVICE WITH PRINTED-CIRCUIT ASSEMBLY CANTILEVERED FROM SHEET-METAL BASE & WITH CLIP FASTENINGS

RELATED PATENT DOCUMENT

This is a continuation-in-part of coowned U.S. utility-patent application Ser. No. 08/684,736, filed Jul. 22, 1996 in the names of Juehui Hong et al. and entitled "INTEGRATED SHELL-AND-CHASSIS CONSTRUCTION FOR A DESKTOP IMAGE-RELATED DEVICE"—and hereby incorporated by reference in its entirety into this document. It issued as U.S. Pat. No. 5,775,825 on Jul. 7, 1998.

FIELD OF THE INVENTION

This invention relates generally to desktop-size image-related devices for acquiring images from or printing text or graphics onto image media; and more particularly to constructional technologies for incorporating a printed-circuit assembly into an enclosure-and-structural system for such a device.

By the phrase "image-related device" we mean to encompass a machine that is a scanner, or a printer, or both (i. e., a copier), or a facsimile transceiver, or can perform any combination of these functions.

BACKGROUND OF THE INVENTION (a) Conventional shell—Typically enclosures for modern desktop use in the office or home have been either:

nonstructural plastic skins over sheet-metal frames, as in usual manufacture of computers; or rigid shells enveloping the mechanism, as in usual manufacture of printers.

Both of these approaches produce structures that are expensive to make, due to relatively thick-walled parts that lead to subtle added costs for material, molding and storage. The first also produces structures that are heavy and so cost more to ship, and the second produces overall structures that are relatively large and so again cost more to store.

(b) Cantilevered mechanical modules—The second technique also has an even more severe disadvantage: the internal mechanisms in general are usually cantilevered within their shells. This construction invites mechanical deformation in event of shock loading, such as can occur during shipping—or even when the machine is moved within a home or office.

Dropping the machine a relatively short distance, or shoving the machine only moderately hard, creates relative acceleration between the chassis and the cantilevered mass. This relative acceleration can cause the mass to act on the cantilevering structure like a force operating through a lever—to exert much higher, damaging levels of force on the components in the region of attachment.

In other words, the deformation magnifies the shock load and so tends to aggravate damage. The relatively heaviness of the parts worsens this problem.

(c) Noncantilevered electronic assemblies—As to internal mounting of electronic boards and assemblies, in a sense the prior-art difficulties are opposite to those discussed above for mechanical modules (although part of the difference may be due to somewhat different usages of the word "cantilever"). Here the normal practice is to firmly screw down electronic modules at all corners, or along opposing edges—or both.

Such practice has three drawbacks. First, installation of screws to assemble electronics into a product is relatively time consuming. In a mass-production environment, each screw takes several seconds—translating into not only cost for labor but also significant aggregate added cost for workstations.

This consideration alone is sufficient motivation to seek mounting arrangements requiring fewer screws. It is a particularly important concern in view of rework requirements, because major electronic assemblies in image-related devices typically have a relatively high rejection rate.

Such assemblies usually carry a very large number of components, many or most of which are simply purchased at wholesale, off-the-shelf as finished products from independent manufacturers, and failure rates of all these components are multiplicative. Finished assemblies therefore constitute a major cause of product failure—even in the testing process that is associated with manufacture.

Accordingly it is common for a particular electronics module to require not only initial installation into a device but also subsequent removal from the device, and then reassembly of a replacement into the device, before the product leaves the factory. Of course this kind of occurrence multiplies the adverse effects of the screw mounting.

(d) Field service, and fastener time—As a second drawback, the same considerations continue into the after-market environment. The same kind of excess time consumption—in both disassembly and reassembly—are necessary when failure occurs in the field.

A very common way of dealing with functional failure, whether in a product purchaser's facility or in a service center, is to change out an electronics assembly that is responsible for the related function. Even in the field, failure of major electronics assemblies remains one of the highest sources of service events.

Of course such failures amount to an undesirable expense regardless of who pays for them, and the manufacturer wishes to cultivate a reputation for products that do not fail in the field—or at least that are not very expensive to fix if they do fail. Hence the manufacturer always has a strong motivation to avoid such failures.

Since it is the manufacturer, however, who most commonly also bears the expense directly, it is particularly natural for the manufacturer to seek manufacturing techniques that minimize the time consumption and therefore the cost of field service. Therefore it is doubly desirable to find manufacturing configurations that make electronic modules very fast and easy to put in and take out.

(e) Access—This third drawback is more peculiar to the aftermarket environment, in which a technician seldom enjoys the luxury of having the entire device initially disassembled on the workbench. Even in the production context, however, when final product testing indicates that an electronic board must be replaced, accessibility of the components for removal and replacement becomes very important.

As mentioned earlier, electronic printed-circuit assemblies are conventionally screwed down along opposite edges or at all corners. When an assembly is thus installed in a relatively crowded case, in common interior layouts other modules of the device obstruct access to at least some of the screws. Just such tight packing, however, is generally required for good economy, as well as space in the end-user's office.

In particular, if entry to the interior is provided only through a relatively narrow or shallow access port, ordinarily just some of the screws can be within easy reach for removal. Such configurations require extra time for removal of other modules, merely to reach mounting screws for replacement of the circuit board—and then to replace those other modules later.

A conceptually and functionally trivial task thus becomes an exceedingly onerous chore: the service technician faces the task of taking apart much of the apparatus, merely to change out a board. It is compounded by the risk of damage (especially hidden damage) to those other modules in the course of the removal and replacement.

Interestingly, this is so even with some devices whose cases come off completely for service—as for instance a typical personal computer. Replacing a motherboard, even when the technician can look straight down at almost all of it, may take twenty to forty minutes.

(f) Solutions to the mechanical problems—The previously mentioned patent document of Hong et al. introduces a radical approach to structure and enclosure design for desktop image-related devices. That document teaches integration of an external shell with an internal framework of several chassis that cooperate to distribute specifically anticipated shock loads in a predetermined way.

The resulting configurations make the most of both investment and weight, since the enclosure essentially functions as one of the structural elements—but without being in itself being heavy or rigid. The invention of the Hong et al. document also resolves several other knotty problems of the prior art, which are detailed in that document but may be summarized here:

vulnerability to shock that is transfered directly through an attachment of an exterior face to an internal chassis;

flexure or failure of shells not strong enough to withstand impact—so that impact passes directly through the shell to apparatus within; and overly demanding requirements for time-consuming, costly alignment (and forcible distortion) to fit shells onto the chassis for installation of mounting screws.

(g) Broad metallic base—Since many image-related devices require high operating frequencies, e. g. for firing of multiple nozzles at high resolution, these devices are subject to stringent regulations on control of electromagnetic interference ("EMI"). Such constraints in turn call for very effective grounding, preferably at several different locations on an electronic assembly. A common approach to meeting these requirements is to screw the main circuit board to a broadly extended metallic chassis element, preferably at the bottom of the device.

To avoid the problems of access mentioned earlier, in a device with such a broad metallic pan or base, an enclosure is often made with bottom access—i. e. with the base itself removable (together with any shell below it) through the bottom of the product. The main circuit board is then taken out through the bottom, with the base.

This option is foreclosed, however, in an integrated structural/enclosure system such as that of Hong et al. previously discussed. Such a product does have a broad metallic base, but its function as an integral part of the structural system, cooperating in the interconnections of the various chassis and shell members, precludes its easy demounting and removal.

Hence it remains to be shown how an effective grounding strategy, as well as relatively quick and easy assembly and disassembly, can be provided for major printed-circuit assemblies while maintaining the benefits of an integrated enclosure-and-structural system. As will be understood, this problem interacts with the access problem discussed above:

If a solid, positive ground could be obtained without access to all the fasteners—at opposed sides—that hold the board in position and also ground it, then technicians would be able to install and remove printed-circuit assemblies much more quickly and easily. Both the grounding and the access would be greatly simplified and improved, particularly in an integrated enclosure-and-structural system.

An integrated system would then be comparable with, for instance, a conventional bottom-access system in ease and rapidity of service. In short, a fastenerless around for printed-circuit assemblies would significantly advance the field of image-related devices.

(h) Conclusion—Conventional approaches have continued to impede achievement of uniformly excellent electronic serviceability as well as mechanical integrity, in lightweight, economical cases and chassis for desktop printing machines. Thus important aspects of the technology used in the field of the invention remain amenable to useful refinement.

SUMMARY OF THE DISCLOSURE

The present invention introduces such refinement. In its preferred embodiments, the present invention has several aspects or facets that can be used independently, although they are preferably employed together to optimize their benefits.

In preferred embodiments of a first of its facets or aspects, the invention is a mounting system for a printed-circuit assembly in a desktop image-related device that operates at a high electronic frequency. The system includes a chassis element for providing a path to ground from such printed-circuit assembly.

It also includes some means, defined in the chassis element, for forcibly engaging the printed-circuit assembly with the chassis element. For purposes of generality and breadth in describing and discussing the invention, these means will be called simply the "forcibly engaging means" or simply the "engaging means". These means act to provide an effective electrical ground, adjacent to the engaging means—and without any separate fastener there for that purpose.

It will be understood that the phrase "without any separate fastener there for that purpose" means that there is no fastener in that region of the forcibly engaging means, and provided for the particular stated purpose of forcibly engaging the circuit assembly with the chassis element to provide an effective ground. The invention thus encompasses, for instance, a situation in which a fastener is present in the same region for some other purpose—such as for example holding the several chassis together or holding in place some other piece of the apparatus, e. g. an electrical connector.

The foregoing may constitute a description or definition of the first facet of the invention in its broadest or most general form. Even in this general form, however, it can be seen that this aspect of the invention significantly mitigates the difficulties left unresolved in the art.

In particular, this aspect of the invention provides a fastenerless ground, thereby mitigating the previously discussed problems of access around, behind and under other modules in electronic apparatus. The invention would accordingly be useful even for a near-full-view enclosure, such as the computer cases mentioned above.

It is particularly valuable, however, in the environment of an integrated structure. Almost by definition, completely opening access to both sides of a major electronic assembly in such a product disrupts the mechanical integrity of the whole structure.

The invention enables removal of a major electronic unit without opening access completely. Only removal of exterior rear trays (for an original document and for fresh printing medium) and a rear cover or port—and electrical connections to the working apparatus within the case—remain necessary.

Considering the very highly integrated character of the structure and enclosure in the preferred embodiment, this degree of relaxation of the access procedure for changing out the electronic assembly represents a major advance. Absent the invention, much more complete disassembly of the several chassis is required.

Although this aspect of the invention in its broad form thus represents a significant advance in the art, it is preferably practiced in conjunction with certain other features or characteristics that further enhance enjoyment of overall benefits.

For example, it is preferred that the engaging means be defined near a first edge of the printed-circuit assembly; and that the apparatus also include fastener means for securing the printed-circuit assembly, near a second edge, to the chassis element. (It will be noted that these fastener means are thus not in the region of the retaining means, but rather are remote and near a different and preferably opposite edge of the circuit assembly.) Therefore, as suggested above, it is possible to remove the printed-circuit assembly upon unfastening it at just one side.

It is also preferable that the engaging means include a pair of mechanical features for capturing the first edge of the printed-circuit assembly at installation. The fastener means secure the printed-circuit assembly, near its second edge, in a position such that these mechanical features pinch the first edge of the printed-circuit assembly—and so provide the desired solid grounding (as well as positive mechanical attachment).

This arrangement enables the assembly to be very securely attached at both sides, through fastening of it at just one side. It also enables the assembly to be detached from both sides, through unfastening of it at just one.

In preferred embodiments of a second of its aspects, the invention is a mounting system for a printed-circuit assembly in a desktop image-related device that operates at a high electronic frequency. Such a printed-circuit assembly is to be understood as having first and second generally opposed edges.

This last statement does not mean that the assembly must be rectangular (though of course it can be) or indeed any specific shape, but only that in a very general way it has edges that are across from each other, or at least somewhat spaced apart from one another.

Now turning to the mounting system itself, the system includes a chassis element. It also includes some means, defined in the chassis element, for supporting the printed-circuit assembly near its first edge.

For purposes of definiteness in discussion, these means will be called the "first raised means", since a particularly convenient feature for performing the supporting function is a raised boss, or alternatively a raised rim, formed in the chassis element. It is to be understood, however, that in general what is called for is simply the relative elevation of one portion of the chassis element in relation to another.

For instance, some part or parts of the chassis element may be recessed beneath portions of the circuit assembly to clear protruding connections or components under the assembly. Then another part, or other parts, that are not recessed will serve as equivalent "raised means".

Also included in the mounting system are some means, defined in the chassis element adjacent to the first raised means, for engaging and capturing the first edge of the printed-circuit assembly. Merely for purposes of definiteness in description, these means will be called the "retainer means". They need not have any particular form, provided that they are defined in the chassis element as distinguished from being one or more separate retainers or fasteners.

The mounting system also includes some means for supporting the printed-circuit assembly near its second edge; these means too are defined in the chassis element. They will be called the "second raised means".

Further included in the mounting system are some means for securing the printed-circuit assembly, near its second edge, to the chassis element. These means will be called the "fastener means", since they may (but do not necessarily) take the form of relatively conventional fasteners such as discrete screws, nuts, clips, screw cams, lever-operated cams etc.

Equivalents of the second facet of the invention, as just described, of course include inversion of the elements stated, or their cooperating relationships. Thus, within the effective scope of certain of the appended claims, a circuit assembly may be retained by means that extend downward rather than upward, and so forth.

The foregoing may provide a description or definition of the second aspect of the invention in its most general or broad form. Even as thus broadly stated, however, this facet of the invention may be seen to resolve problems of the art.

In particular this second aspect of the invention specifically provides a retention geometry in which a circuit assembly can be installed, or removed, working from just one side of the host apparatus. Since the retainer means engage and capture one edge of the circuit assembly, actuation of the fastener means along the opposed edge suffices to hold both sides firmly to the chassis—or to release them from the chassis.

Nevertheless this second main facet of the invention is preferably practiced with certain further features or characteristics that optimize the enjoyment of its benefits. For instance the mounting system is advantageously used in an image-related device that is subject to mechanical shock loads during shipping and the like; and preferably the retainer means are spaced vertically above the first raised means by a distance which is such as to place the printed-circuit board, when captured by the retainer means and secured by the fastener means, under very slight flexure.

Such a configuration runs strongly counter to conventional wisdoms, in that any flexure of circuit boards is avoided in conventional mechanical design—particularly when shock loads are anticipated. The conventional understanding arises from the long-standing realization that bending of printed-circuit assemblies due to residual stress, thermal expansion, manufacturing procedures, material unevenness, soldering etc. can cause printed-circuit failure.

Nevertheless it has been verified that the invention functions without circuit damage even under flexures an order of magnitude greater than actually imposed, and with environmental disturbances far exceeding any loading, vibration, temperatures etc. ordinarily encountered in shipping, storage or operation. We believe this surprising result is due in part to recent great improvements in the manufacturing technology of printed-circuit assemblies.

Composite materials are now widely used in circuit boards; and placement and orientation of components on assemblies are now better. As a result small amounts of bending are now common and harmless, but design conventions have not kept pace with these developments. Modernly it is allowable to relax the tight restrictions on flatness, bow, stress, etc. The invention takes advantage of these advances.

Another preference is that no separate fastener hold the printed-circuit assembly to the chassis element near the first raised means. It is also preferred to use the invention in conjunction with a printed-circuit assembly that includes grounding pads formed on a surface of the assembly that faces said chassis element; in this event the first raised means or said second raised means (or both) are metallic, and the metallic raised means engage the grounding pads.

Here also preferably the chassis element is of formed metal. We also prefer that the mounting system include plural additional functional chassis modules and one or more casing elements, all structurally integrated with said chassis element. Other preferences and benefits will be set forth in the later "DETAILED DESCRIPTION" portion of this document.

In preferred embodiments of yet a third basic aspect or facet, the invention is a desktop image-related device that operates at a high electronic frequency and that is subject to mechanical shock loads during shipping and the like. The device includes a printed-circuit assembly having first and second generally opposed edges.

It also includes a chassis element. Additionally included is at least one first raised structure, defined in the chassis element, for supporting the printed-circuit assembly near its first edge.

The device furthermore includes at least one retainer structure, defined in the chassis element adjacent to the at least one first raised structure, for engaging and capturing the first edge of the printed-circuit assembly; and at least one second raised structure, defined in the chassis element, for supporting the printed-circuit assembly near its second edge. In addition the device includes one or more fasteners for securing the printed-circuit assembly, near its second edge, to the chassis element.

The foregoing may constitute a definition or description of preferred embodiments of this third facet of the invention in its broadest or most general form. Even in this broad manifestation, however, the invention can be seen to provide a complete image-related device having generally the same advantages as the mounting system of the second aspect.

Still it is preferable to practice the third facet of the invention in conjunction with certain other characteristics or features that make the most of the invention as described. For example preferably the device further includes plural additional chassis elements secured to the chassis element and obstructing access to at least some of the at least one retainer structure. In this preferred arrangement the printed-circuit assembly is removable from the device without gaining access to the at least one retainer.

In the preferred configuration just outlined, the printed-circuit assembly is removable from the device by unfastening of the fasteners, angling the assembly out of engagement with the at least one retainer structure, and shifting the assembly away from the at least one retainer structure. Preferably no separate fastener holds such printed-circuit assembly to the chassis element near the at least one first raised structure. (It goes without saying that any electrical connections within the case are also disconnected in preparation for removal.)

Preferences described above for the first and second aspects of the invention are applicable here too, as are others set forth in the "DETAILED DESCRIPTION" section.

In preferred embodiments of a fourth of its aspects, the invention is a method of installing or removing a printed-circuit assembly that mounts within an image-related device which operates at a high electronic frequency. This form of the invention is particularly for use with a printed-circuit assembly that has a pair of generally opposed edges, and with an image-related device that has a chassis with retainers and raised means defined in it.

The method includes the step of inserting a first edge of the assembly between the retainers and a first group of the raised means. It also includes the step of then rotating the assembly into an operating position.

The position is such as to engage the assembly with a second group of the raised means near a second edge of the assembly—and also to pinch the first edge of the assembly between the retainers and first group of raised means. Another step is then securing the assembly in that position.

An alternative to all of the foregoing steps (performed in the order recited), also within the scope of the third aspect of the invention, is reversing all of those steps—which is to say, doing the opposite of the recited steps, and in the opposite order—to remove the assembly.

In this third aspect of the invention, preferably the securing step includes using fasteners only near the second edge of the assembly.

All of the foregoing operational principles and advantages of the present invention will be more fully appreciated upon consideration of the following detailed description, with reference to the appended drawings, of which:

BRIEF DESCRIPTION OF THE DRAWINGS

FIG. 2 is a top plan;

FIG. 3 is a front elevation;

FIGS. 4 and FIG. 4' are right (i. e. interior) side elevations, identical except for scale as explained above;

FIG. 4 is a rear elevation;

FIG. 5 is a left side elevation;

FIGS. 7 and 7', identical but for scale, are isometric views taken from below and to the right rear of the cover;

FIGS. 8 and 8' are isometric views taken from above and to the right front;

FIG. 9 is a like view taken from above and to left rear;

FIG. 11 is a top plan;

FIG. 12 is a rear elevation;

FIG. 13 is a left side (interior) elevation;

FIG. 14 is a front elevation;

FIG. 15 is a right side elevation;

FIG. 16 is an isometric view taken from the right rear;

FIG. 17 and FIG. 17' are isometric views taken from below and to the left of the cover;

FIG. 18 is a top plan of only the floor of the cover;

FIG. 19 is a bottom plan;

FIG. 20 is a rear elevation of the base, but drawn inverted for clearer indication of alignments with the adjacent plan;

FIG. 21 is a left side elevation of the base, but shown rotated clockwise ninety degrees for clearer indication of alignments with the plan;

FIG. 22 is a top plan of the base;

FIG. 23 is a right side elevation thereof but rotated counterclockwise ninety degrees for clearer showing of alignments;

FIG. 24 is a front elevation in section, taken through a dogleg path (relative to the FIG. 22 plan) passing through various key features of the base—to show these features generally but without identifying details that are not central to the present invention;

FIG. 25 is a front elevation;

FIG. 26 is a detail drawing of the bottommost (as drawn) part of the FIG. 23 elevation, but greatly enlarged;

FIG. 27 is an isometric view, taken from above and to the right front, of an electroacoustic speaker component that is mounted to the base and also secured to the media chassis;

FIG. 28 is a right side elevation of the FIG. 27 speaker;

FIG. 29 is an isometric view, taken from above and to the right front, of the base;

FIG. 35 is a highly schematic drawing, generally in cross-section along the dogleg path 35—35 in FIG. 29, showing the mechanical relationships of key components in a preferred embodiment of the present invention—with the components in positions typical of the initiation of their assembly;

FIG. 36 is a like drawing of the same components in positions typical of a later stage in their assembly;

FIG. 37 is a like drawing of the same components with their assembly completed.

FIG. 39 is an isometric view of the rear of the device, with the trays and rear panel/port in place; and FIG. 40 is a like view with the trays and rear panel removed.

DETAILED DESCRIPTION OF THE PREFERRED EMBODIMENTS

1. Integrated Structure and Enclosure

Figure 1:
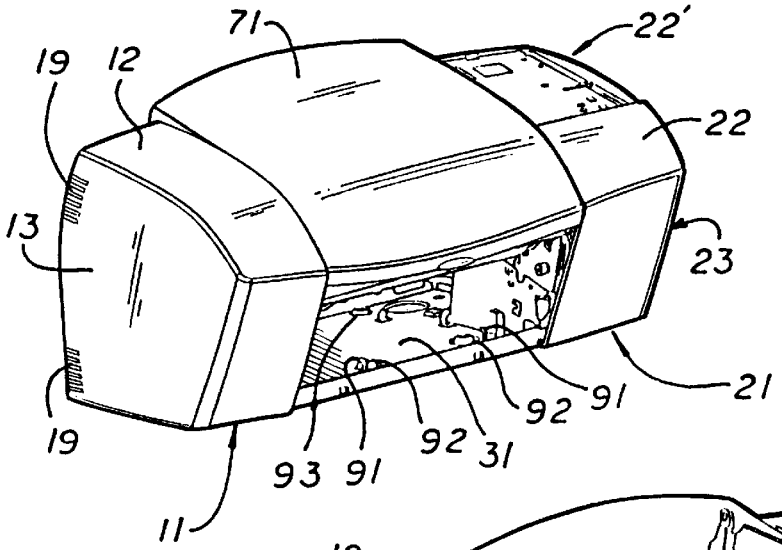
FIG. 1 is an isometric view, taken from above and to the left, of the exterior of a preferred embodiment of the invention (without control panel or paper trays in place)
Figure 1A:
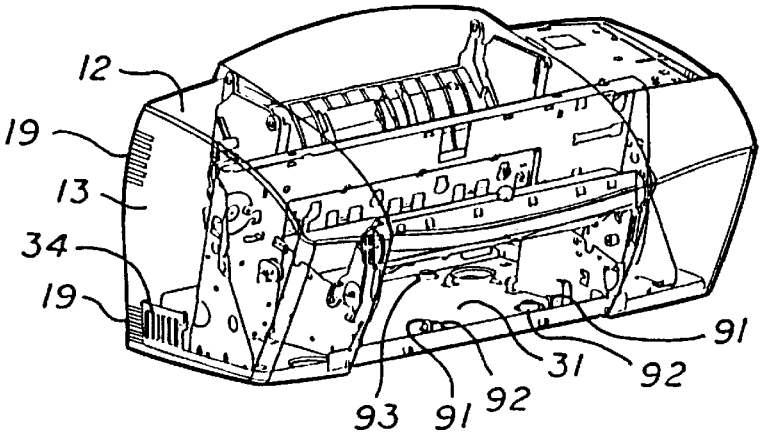
FIG. 1*a* is a like view of the same embodiment but with the side covers and top dust cover treated as if transparent, to show the covers in their relationships to all the main internal chassis elements within.

Preferred embodiments of the enclosure-and-structural system related to the invention include opposed left and right side covers 11 and 21 (FIGS. 1 through 1*b*) of thin molded plastic. These are mated with an intermediately disposed formed base 31 of formed sheet metal.

In purest principle, covers 11, 21 could be disposed at other positions with respect to the base 31, or a greater number of covers could be provided in various regions about the base. Therefore the phrase "side cover" encompasses a cover at front or rear as well as, or instead of, left or right.

Three main metal chassis 41, 51, 61 are rigidly mounted on the base 31 and are fastened strongly to both covers 11, 21. A dust cover 71, which does not contribute significantly to the structural relations of the system, is rotatably secured to hinges 67 at the upper rear of the rearmost chassis 61—which is a media chassis.

Each cover 11, 21 has a respective top panel 12, 22 that is formed in a compound-curved surface, but in the right cover 21 the upper rear portion of this curved top 22 is interrupted by an extended well 22' for mounting of a control panel (not shown). Each cover also has a respective outboard surface or side panel 13, 23, also formed in a curved surface that is compound—but less severe.

The outer rear corner of each cover is perforated by respective grillwork 19, 29 for ventilation and—at lower left rear—for emission of sound from an electroacoustic speaker 34' (FIGS. 27 and 28) that is mounted within an upstanding sheet-metal grill 34 at the left rear of the base 31.

Figure 30:
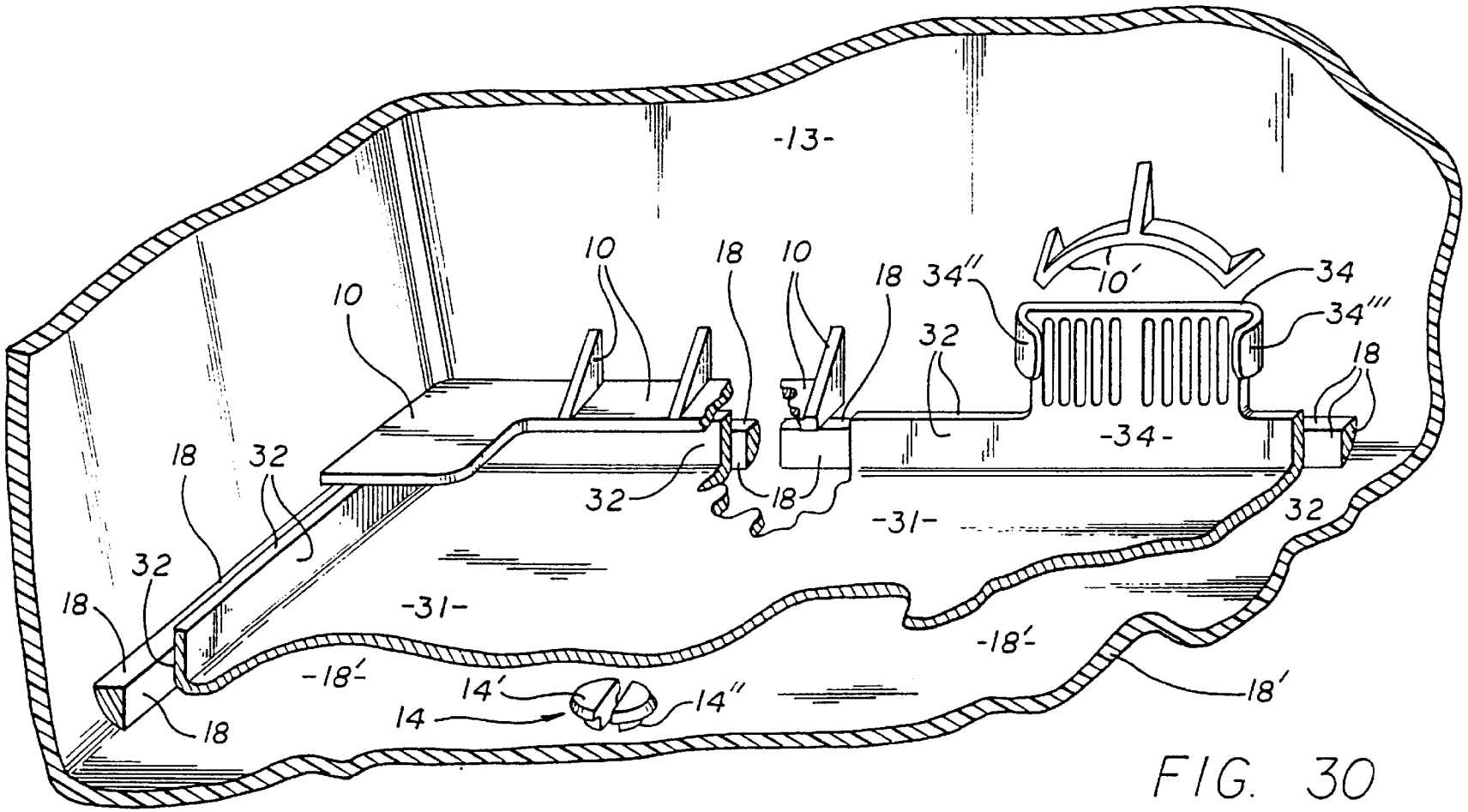
FIG. 30 is an isometric or perspective view of the left interior of the left-side cover with only part of the mating base, all taken from above right rear, drawn partially broken away, and highly schematic.

Integrally formed within each side cover 11, 21 is a circumferential plastic stop or rib 18, 28—rising from the floor 18', 28' just where the walls join the floor, as best shown for the left side cover in FIG. 30. This illustration is drawn broken away around all its edges, and also particularly near one end of a shelf-like structure at left center, to show more clearly the nature of the sandwich of thin components along the periphery of the floor 18', 28'.

As shown, the rib or stop 18, 28 cooperates with the floor 18', 28' to form a contoured nest. The upturned shallow rim 32 (see also FIGS. 20 through 26, and 29) and floor of the base 31 fit closely into this contoured nest 18, 28, 18', 28'.

These features define the position of the base 31 within the cover 11, 21 very positively, with respect to three degrees of freedom. Those are: fore-and-aft translation, transverse (left-to-right) translation, and rotation about a vertical axis.

Also integrally formed within the rear corner of each side cover 11, 21, just above the floor 18', 28', is a partially circumferential plastic retaining flange or limiter 10, 20. Each corner limiter 10, 20 cooperates with the floor 18', 28' of the respective cover to define a lateral groove or slot. The upturned edge 32 of the rear corner of the base 31 fits rather tightly into this slot. The limiter 10, 20 and floor 18', 28' together thus vertically restrain the upturned edge 32 of the base 31 quite tightly.

Figure 27:
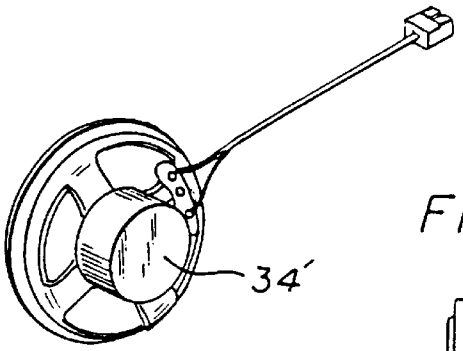
Figure 28:
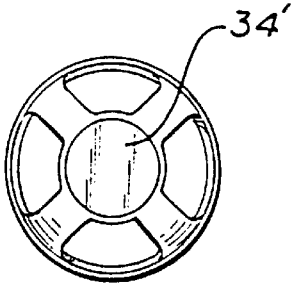

Also integrally formed in only the left-side cover outboard wall 13 is an additional limiter 10' (FIG. 30). After assembly this limiter 10' is positioned directly above the grillwork mount 34 that holds the electro-acoustic speaker 34' (FIGS. 27, 28).

The circular speaker 34', when in its mount 34' (and held tightly in place by crimping of its retainers 34", FIG. 30), helps to suppress any residual upward mobility of the base 31 left rear corner. Thus the speaker is effectively integrated into the structural system.

This interfitting of the base edge 32 against the rib 18, 28—and between the floor 18', 28' and the limiters 10, 10', 20—we term a "hand-in-glove fit". The restraint contributed by the floor 18', 28' and limiters 10, 10', 20 is positive with respect to two additional degrees of freedom: vertical translation, and rotation about a transverse (left-to-right) horizontal axis.

In addition the limiters 10, 10', 20 and floor 18', 28' together limit motion with respect to rotation about a fore-to-aft horizontal axis. This constraint alone, however, is not positive.

The base 31 as restrained solely by the limiters 10, 10', 20 and floor 18', 28' has some residual freedom to rotate slightly about the fore-to-aft horizontal axis. We therefore refer informally to this particular constraint as taking up a "half degree of freedom".

To provide positive constraint with respect to rotation about that axis, we add a snap fastener 14, 33 (and 24, 33 in the right-side cover). This fastener includes an integrally molded, sharply necked plastic boss 14 (best seen in FIG. 30) upstanding from the floor 18', 28'.

The other part of the snap fastener is a mating aperture 33 (FIG. 29) in the metal base 31. In assembly of the base 31 into floor of the cover 11, 22, the upward tip 14' of the boss 14 is radially compressed to pass into and through the aperture 33, in a tight interference fit.

After entering the aperture 33, however, when the neck 14" of the boss 14 reaches the aperture the resilient tip 14' springs outward, capturing the base 31 closely against the floor 18', 28' of the side cover 11, 12. This firm capture prevents escape of the base 31 from its hand-in-glove fit with the side cover 11, 12.

In particular, because the underside of the boss tip 14' is stepped abruptly, the boss 14, 24 also very greatly reduces freedom of the base 31 to tilt upward out of contact with the floor 18', 28'. Thus the last "half degree of freedom" is closed off.

As can now be appreciated, with the stabilization provided by this connector, the hand-in-glove fit is capable of transmitting forces in all directions.

The three main chassis 41, 51, 61 are secured to the base 31 by mounting bosses, hooks and anchors 36 (FIG. 29) formed in the base 31. The shallowly upturned rim 32 of the base partly stabilizes the base itself against flexure, especially in the contoured regions near the corners of the base.

Added stability is provided by the taller rim features 35 at front and rear of the base, which also are specially shaped to engage mating paper input and output trays (not structural, and not shown) at rear and front respectively. Also defined in the base 31 are downwardly extending shallow feet 37.

From what has already been said, it will be clear that the level of integration even with respect to the base alone is unusually high, complicating removal of any single element from the system. The foregoing extended discussion of the integration between the base and other elements of the structure, in the preferred embodiment of the invention, is only illustrative of the degree of integration of all the elements with one another.

A like presentation, with comparably extended discussion of the other elements—detailing the integration of the several chassis and cases with one another—appears in the above-mentioned patent document of Hong et al. and will not be repeated here. It is to be understood, however, that in addition to their connections with the base, the chassis also are connected to each other, and stabilized against the covers, at several points and in various ways.

These interconnections are such as to further complicate any procedure of loosening or removing any one of the chassis individually. Loosening or of course withdrawing any of the several chassis in general affects the others, and in particular replacement or retightening of a particular chassis should be accompanied by careful mechanical realignments to restore correct operating relationships.

2. Disposition and Connection of the Printed-Circuit Assembly

Figure 1B:
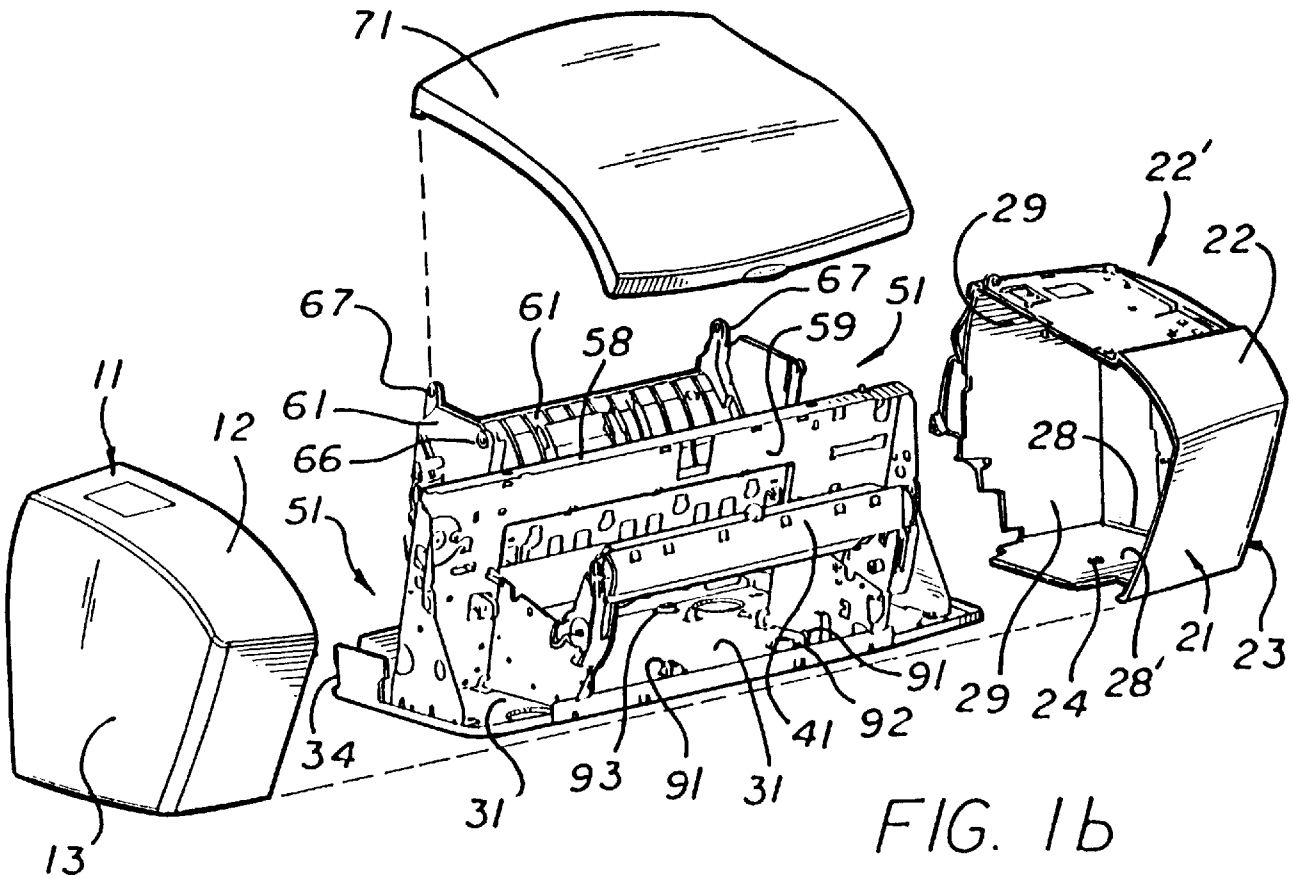
FIG. 1*b* is a like view of the same embodiment but exploded to show the internal chassis elements separately from the covers.
Figures 2, 3, 4, 5, 6, 7, 8, 9, 10:
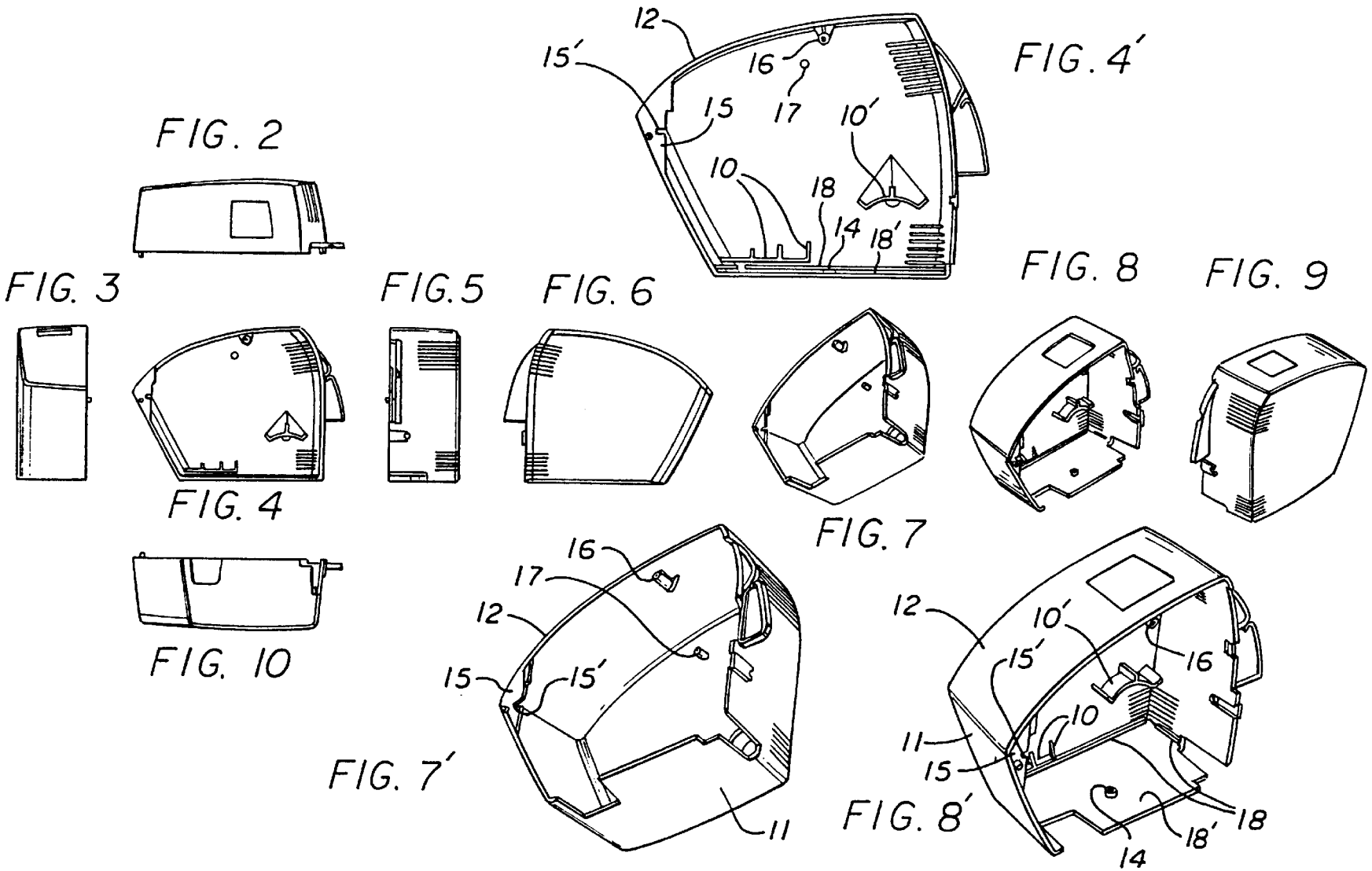
FIGS. 2 through 9 (and 4', 7∝ and 8') are drawings of the left side cover of the same embodiment as seen from various positions—all to consistent scale, except that the drawings with prime symbols following the numbers are drawn significantly enlarged to better show details—and in particular.
FIG. 10 is a bottom plan.
Figures 11, 12, 13, 14, 15, 16, 17, 18, 19:
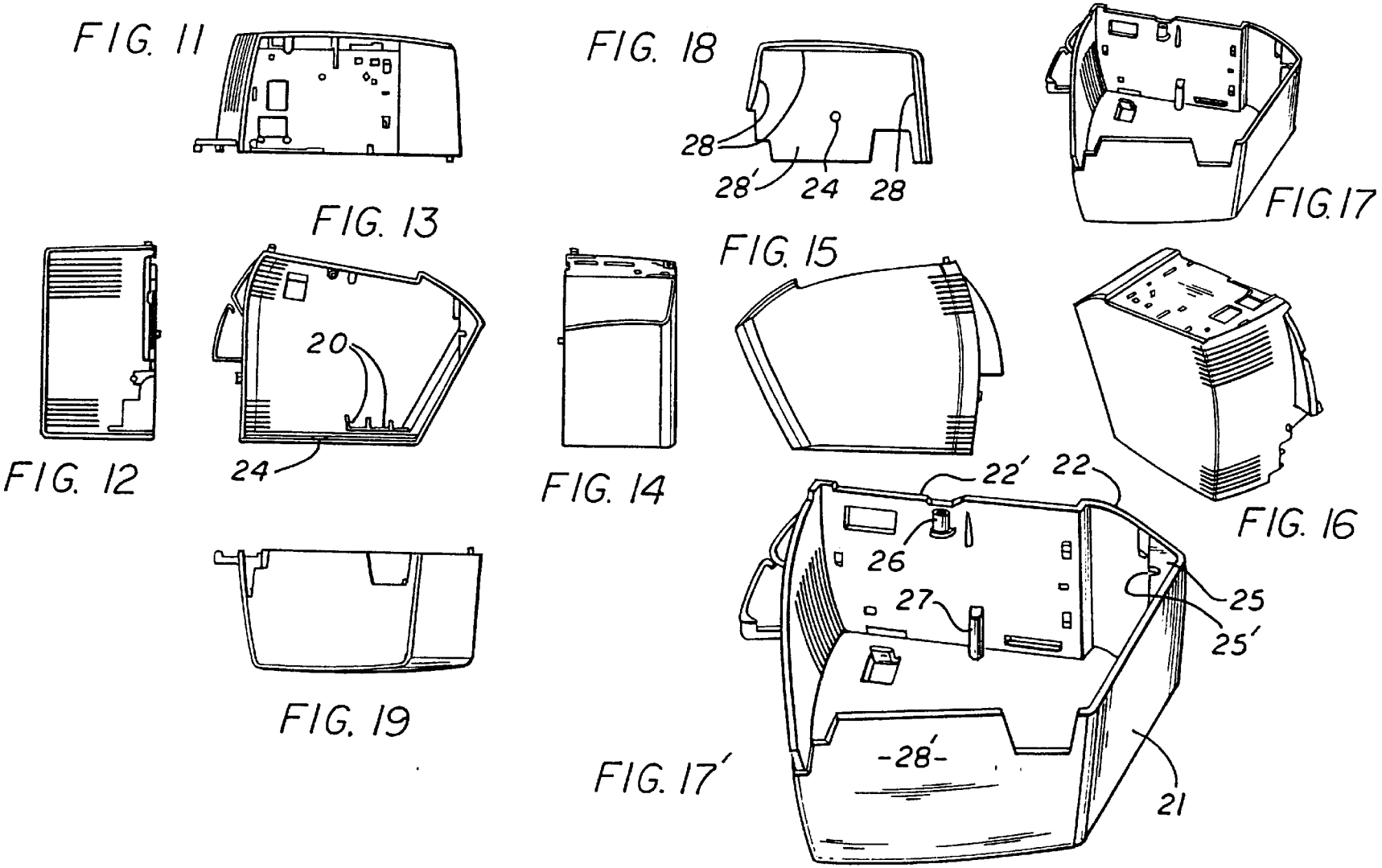
FIGS. 11 through 19 (and 17') are like drawings of the right side cover of the same embodiment.
Figure 20:
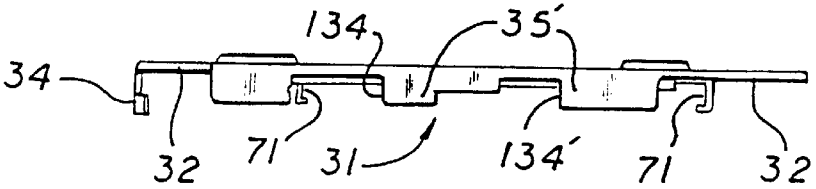
FIGS. 20 through 29 are drawings of the base (and one associated component, the speaker) of the same embodiment, as seen from various positions.
Figure 23:
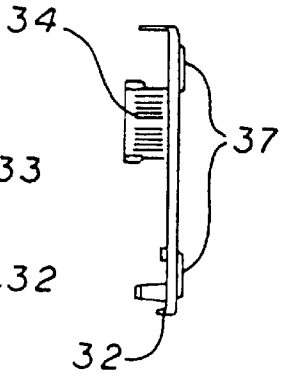
Figure 26:
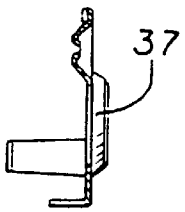
Figure 22:
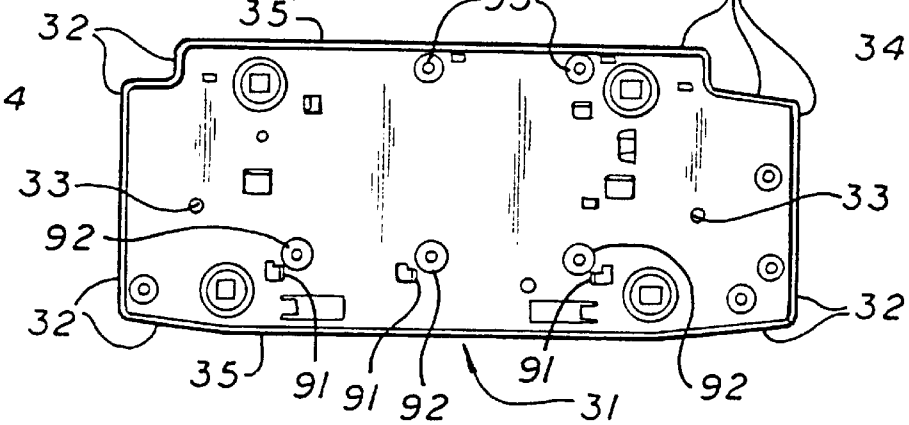
Figure 21:
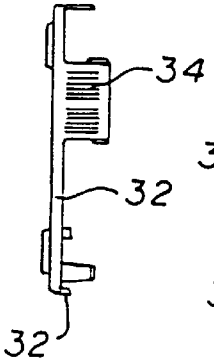
Figure 24:
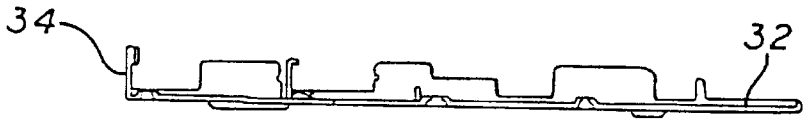
Figure 25:
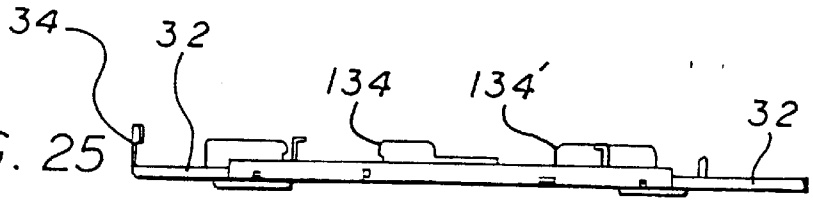
Figure 31:
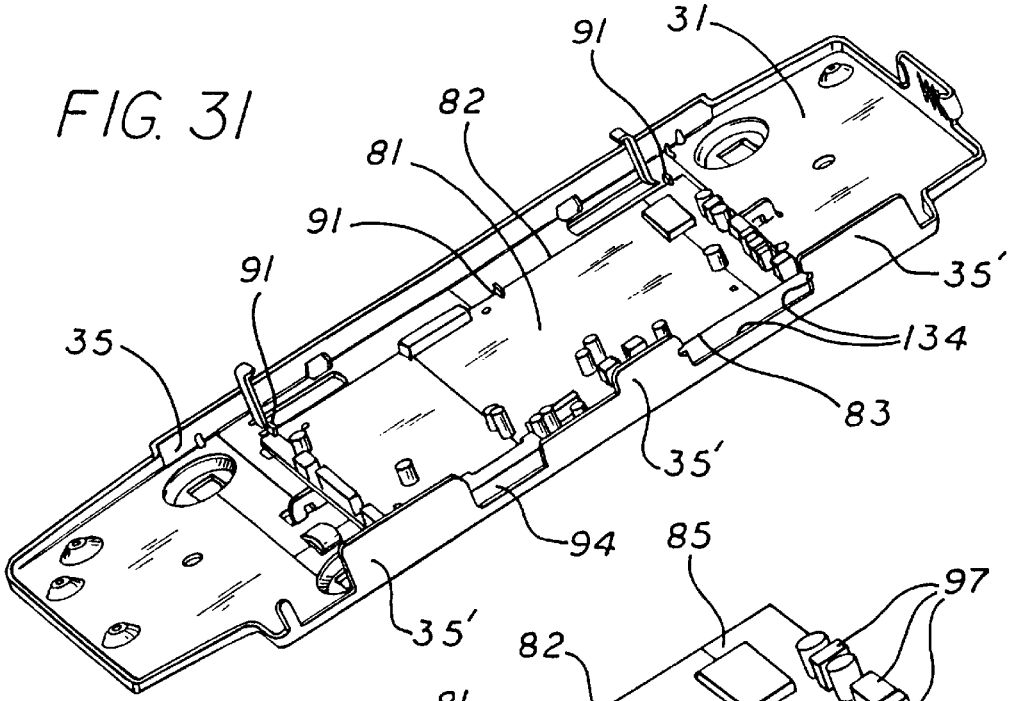
FIG. 31 is a view of the entire base, like FIG. 29 but taken from a vantage somewhat similar to that of FIG. 30—namely from above and to the right rear—and with the printed-circuit assembly fully installed in the base (but, for clarity in showing of the base, omitting an input/output connector that is soldered at a rear corner of the circuit assembly)
Figure 32:
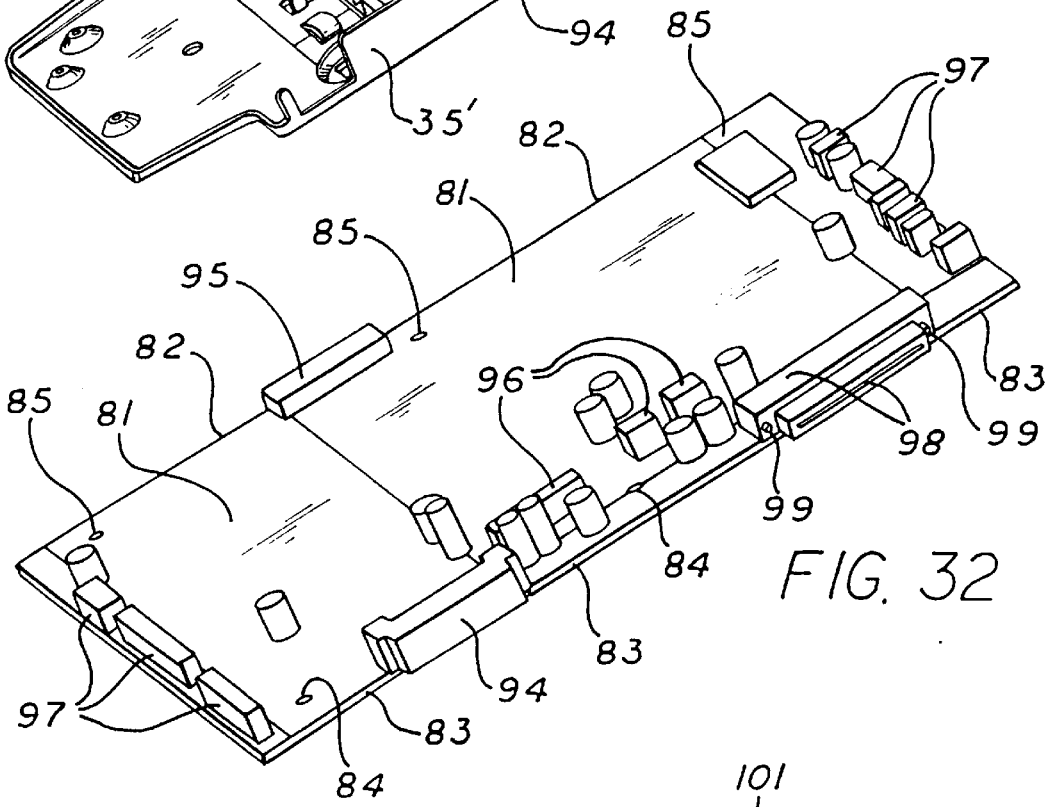
FIG. 32 is a like view of the printed-circuit board alone.

It can now be appreciated that the printed-circuit assembly 81 (FIGS. 31 and 32) is difficult to remove or install—in the absence of the present invention—once the image-related device is generally assembled. The circuit assembly 81 lies (FIG. 31) over the central portion of the base 31, straddled by the three main chassis 41, 51, 61 (FIG. 1*b*). In particular the forwardmost of these, the starwheel chassis 41, is spaced quite closely above the front wall 35 (FIG. 29) of the base 31, generally only about two inches above the circuit assembly 81. Such a close spacing is inadequate for safe insertion of a common screwdriver (and a technician's fingers) to remove vertically aligned screws or other fasteners.

Fasteners with vertically aligned axes represent the most economical and straightforward approach, to engage mounting holes formed through the horizontally extended circuit board. (Of course other kinds of fasteners, such as camming types which change the direction of applied fastening forces, may be substituted—but insertion time remains relatively expensive, and as will be seen such fasteners are costly in comparison with the expense of forming retaining hooks in a sheetmetal base. Horizontally aligned fasteners are another alternative, but require a relatively costly preattachment of some sort of fastener block to the circuit board.)

Along the front and rear edges 82, 83 (FIG. 32) of the board, such mounting holes 85, 84 respectively are illustrated and in fact are provided, in a printed-circuit assembly for use in a preferred embodiment of the invention. The holes 85 along the front edge 82 have enabled comparison of operation using the invention vs. operation using conventional fasteners.

Instead of a standard screwdriver, a right-angle screwdriver or ratchet wrench might be used to install screws in the frontal holes 85—but this would be unduly time consuming, and would also pose a threat to electronic components projecting upward from that assembly 81. Their interconnections with the circuit board are frail and subject to damage by such tools, particularly under the starwheel chassis 41.

Safe removal of the circuit assembly 81, absent the present invention, may therefore require at least removal of the starwheel chassis 41. This in turn requires not only removal of all three three media trays 102–104 (FIGS. 39 and 40) (not shown) front and rear, and demounting of the covers 13, 23 but probably also at least loosening of one or both of the printer chassis 51 and media chassis 61. (Preferably the entire print mechanim—i. e., all the internal chassis 41 through 61—should be removed.)

Access to the mounting holes 84 near the rear edge 83 of the circuit assembly 81, and at the rear of the image-related device, is less problematical. The media chassis stands up higher above the base, and fastener tools are more readily positioned for use.

Figure 34:
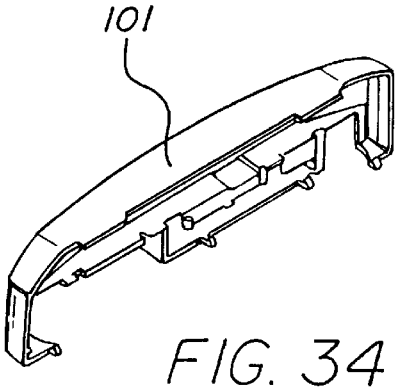
FIG. 34 is a like view showing a rear wall or exit port for printed copies leaving the device.
Figure 38:
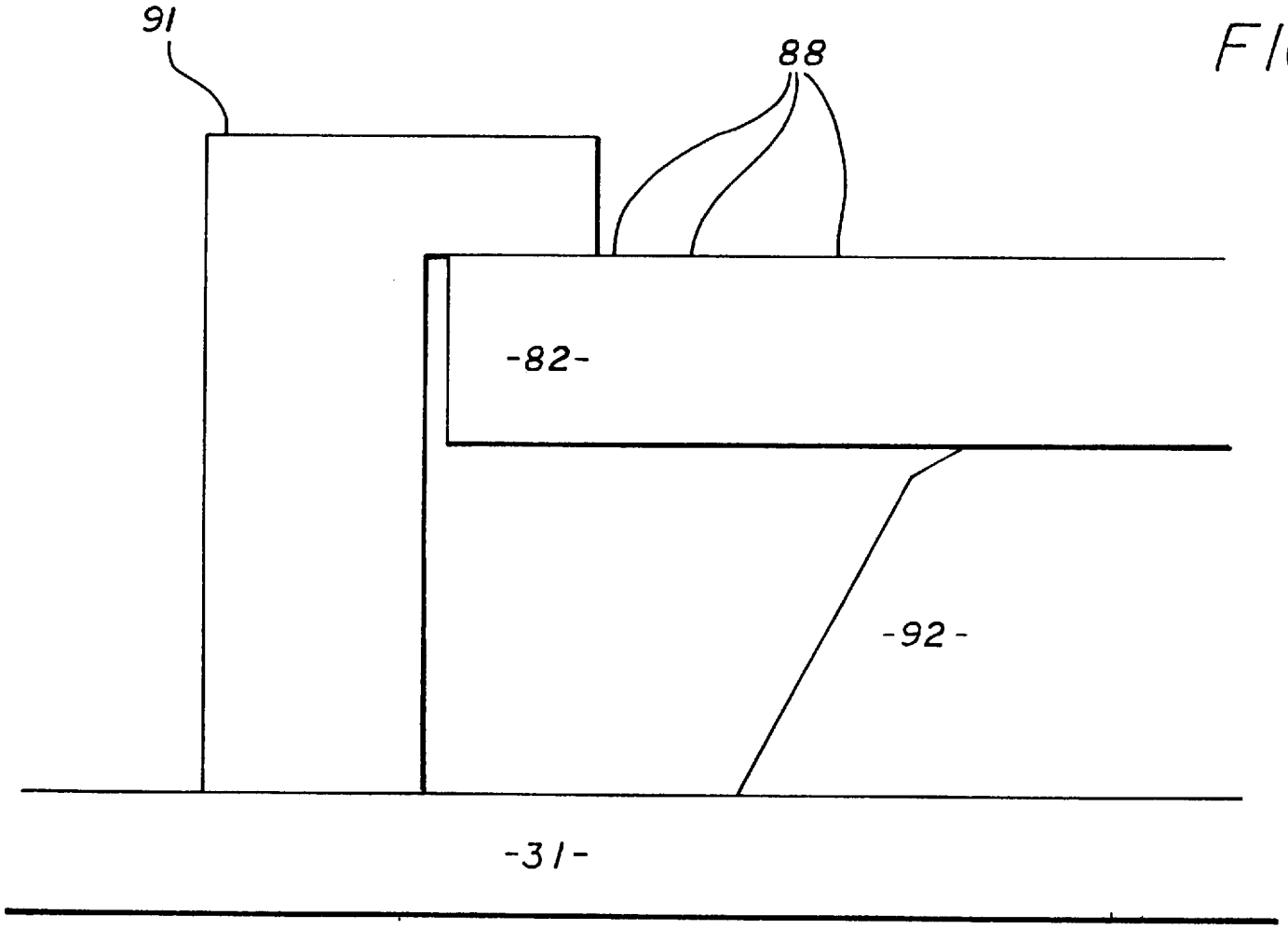
FIG. 38 is a like view of a portion of the completed assembly but very greatly enlarged.

Even for such rear access, a certain amount of disassembly is unavoidable. In particular the vertical rear port or panel 101 (FIGS. 34 and 39) of the image-related device must be removed to gain access to the interior (FIG. 40). This panel 101 holds a so-called "line-interface unit" or phone/FAX adapter 105.

The line interface unit 105, if present, must be unplugged from the modem receptacle 94 at the rear. Also to be demounted are an automatic sheet feeder 102, which supplies fresh sheets of printing medium to be imaged in the machine, and an automatic document feeder 103, which supplies document pages to be copied—both feeders 102, 103 being above the panel/port 101 at the rear as shown and a printed-image receiving tray 104 at the front.

Also necessary in preparation for removing the printed-circuit assembly is disconnection of some dozen electrical connectors from that assembly. One such connector 95 on the front edge of the circuit assembly is directly accessible through the open front of the device, and three connectors 96 near rear center of the circuit assembly are directly accessible at the open rear. To disconnect another eight connectors 97 along left and right edges, too, the technician reaches in from the open rear.

Soldered to traces along the rear edge of the circuit board is a master input/output connector 98 (FIG. 32), preferably a Centronix® type. Conventional fasteners, preferably screws, are removed from two horizontally aligned holes 99 at the left and right ends of this input/output connector—as well as two vertically aligned holes 84 through the printed-circuit board, near the rear of the assembly. (For clarity in showing of the sill detail 134 in FIG. 31, the connector 98 is omitted from that drawing.)

Of course the specific relative difficulty and ease of access at front and rear, as just described, are peculiar to the particular image-related device illustrated. As a general matter, however, it may be expected that ease of access to the interior of such a device will be harder along one side, or end, and easier along another. In the preferred embodiment the present invention exploits this differential accessibility.

Figure 33:
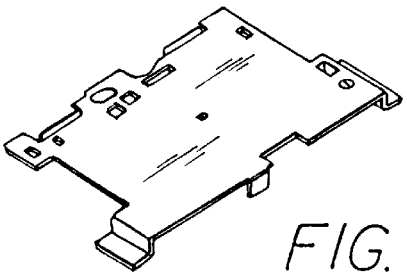
FIG. 33 is a view like FIG. 29 and taken from generally the same position, but showing only an optional shield for the printed-circuit assembly.

Additional electromagnetic-interference shielding can be provided through use of an auxiliary shield (FIG. 33) positioned over the printed-circuit assembly 81. Such a shield renders installation or removal even more awkward. The need for such a shield is to be avoided if possible, and this goal puts an even greater premium on attainment of extremely effective grounding at the mounting points.

In summary, removal or installation of a printed-circuit assembly 81, in environments such as illustrated, is time consuming and expensive in the absence of the present invention.

3. Mounting and Demounting of the Printed-Circuit Assembly

Now for comparison, assuming use of the present invention the construction and procedures are simple but distinctly different.

To forcibly engage the forward edge 82 of the printed-circuit assembly 81, we form in the sheetmetal base 31 a series of retainers 91 (FIGS. 1 through 3, 20, 22, 24, 25, 29 through 31, and 35 through 38) and raised shapes such as bosses 92. The bosses 92 are identically the same as used to engage screws or like fasteners along the forward edge 82 of the assembly 81 in the absence of the invention.

The retainers 91 and forward bosses 92, formed in the base 31, are paired as shown and are slightly offset in both the transverse and longitudinal directions of the base 31. Also formed in the base 31 are rearward bosses 93 which—analogously to the forward bosses 92—are identically those used to engage screws or like fasteners along the rearward edge 82 of the assembly 81 in the absence of the invention.

When installation is complete, the forward edge 82 of the circuit assembly 81 lies atop the forward bosses 92 and is held (FIG. 31) under the heads of the retainers 91. The rearward edge 83 of the circuit assembly 81 is held down against the tops of the rearward bosses 93 by conventional fasteners inserted through the mounting holes 84 in the circuit assembly 81 (FIGS. 31, 32 and 37)—and also by the conventional fasteners inserted into the mounting holes 98 in the input/output connector 98.

Preferably the mechanical connections between this connector 98 and the upstanding rear sill 134 of the base 81—and alignment of the modem block 94 with its sill 134'—serve as primary references for insertion of the front edge 82 of the board by the correct distance into the space between the retainers 91 and bosses 92. Metallic grounding pads 89 formed on the underside of the printed-circuit assembly 81 align with the forward and rearward bosses 92, 93.

For understanding of the fully effective grounding and the solid mechanical connection provided by this configuration, particularly at the forward positions, reference to the installation sequence of FIGS. 35 through 37 will be helpful. In these very schematic drawings the electronic components mounted on the circuit board are not shown, but of course they are fully assembled on the board before installation begins.

Initially the technician—working from the rear of the image-related device (i. e., from the right side of these three drawings)—inserts the forward edge 82 of the circuit assembly 81 into the image-related device. The assembly 81 thus moves, from the rear, under the pre-assembled chassis 41, 51, 61 (FIG. 1 etc.).

Holding the assembly 81 at an angle, the technician moves its forward edge 82 to rest on the forward bosses or other raised features 92, and gently shifts that edge 82 forward toward the vertical-post portion of each retainer 91 (FIG. 35). In its angled orientation, the edge 82 of the assembly 81 slides very readily under the head portion of each retainer 91. The technician controls the distance of insertion by aligning the connector 98 with its mating upstanding sill or frame 134, and similarly the modem block 94 with its like sill 134', both formed in the upstanding rear panel 35' of the base.

Next, while keeping the board aligned as just described, so that its forward edge 82 is under but not pressing against the retainers 91, the technician lowers (FIG. 36) the rear edge 83 into contact (FIG. 37) with the rearward bosses 93, and secures the rear edge against those bosses 93 with two conventional fasteners 86. In addition, two like fasteners (not shown) are passed through the notches formed in the sill 134 and into the input/output-connector mounting holes 99.

At the front of the assembly, the vertical spacing between the head of each retainer 91 and the top of the associated forward boss 92 is slightly smaller than the thickness of the forward edge 82 of the printed-circuit assembly 81. The resulting interference fit, though only a small fraction (typically about one quarter) of a millimeter, squeezes and flexes the circuit board very slightly, particularly in the short region 88 (FIGS. 37, 38) between the retainer 91 and boss 92, thus gripping and holding the board very tightly in position.

It is most economical and straightforward to use a printed-circuit board that is essentially planar, and with substantially uniform thickness. Therefore it is desirable that the base 31 have a substantially flat and broadly extended region, and that the bosses 92, 93 all rise from that region to substantially the same height.

In this way the bosses, in the aggregate, define for the circuit board a platform that is essentially planar. With these assumptions in mind, the above-mentioned interference fit has been described by indicating that the distance measured vertically (parallel to the thickness dimension of the board) from each boss 92 up to the underside of its associated retainer or hook 91 is very slightly smaller than the thickness of the printed-circuit board.

As will be understood, however, equivalent relationships are applicable if the circuit board is not planar (for example if it is trimmed down or built up, or carries a pad or pedestal of some sort, or is stepped or even curved, in the region where it is gripped)—or if analogous variations are present in the base, or both. The vertical gap between boss and retainer head is established in accordance with, on the one hand, allowable stresses in the circuit assembly, and on the other hand the electronic requirements for grounding and EMI.

Preliminary finite-element analysis indicated that this invention would be successful. Systematic tests on finished units have now been conducted to verify integrity of the printed-circuit assembly in the presence of stresses induced by the present invention. From the mechanical standpoints, the invention has passed tests for strength, creep, static and dynamic random disturbances (e. g. vibration), mechanical shock, thermal shock and heat aging. From the electric and electronic standpoints, the invention has passed tests for grounding and at the time of writing can reach the same level in EMI testing as the device with conventional screw mounting.

Interestingly, a parametric comparison of vibration-induced dynamic strains under both mounting conditions did not show sizably higher strains in the new mounting; this would relate to fatigue under, say, shipping.

Figure 29:
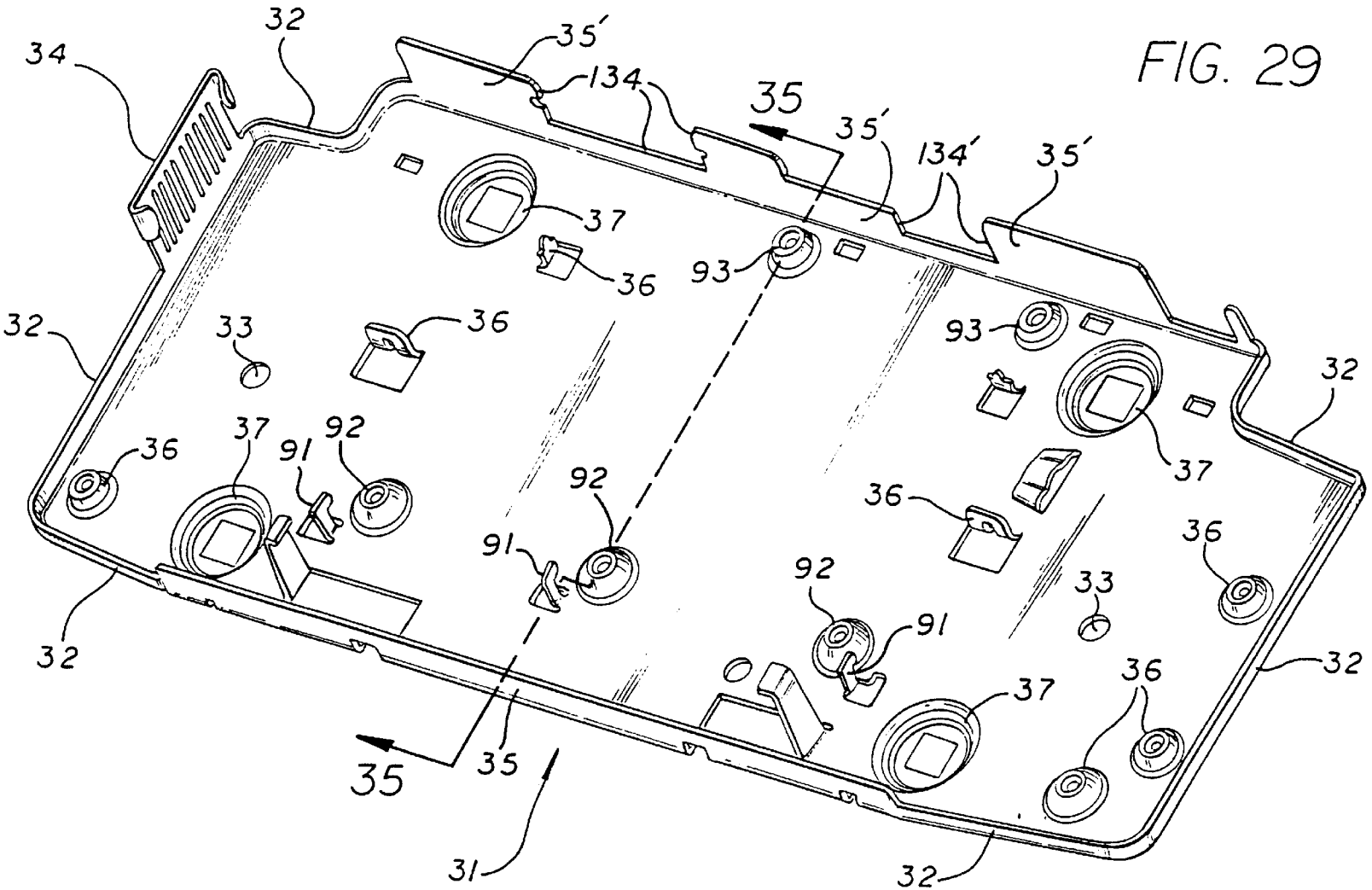

The flexure in the region 88 between the retainer 91 and boss 92 may be compound, since as mentioned earlier the bosses and retainers are offset not only in the transverse direction seen in FIGS. 35 through 37 but also in the longitudinal direction (seen in FIG. 29 at the dogleg segment of the line 35–35). In addition, some transverse flexure may be distributed over the "cantilevered" segment 87 of the circuit assembly 81.

In short, the printed-circuit assembly 81 is used as a lever to pinch its own forward edge 82 between the retainers 91 and forward bosses 92. In the process the grounding pads 89—those at the forward bosses 92 as well as those at the rearward ones 93—are very firmly squeezed against the tops of the bosses.

Very advantageously, the invention need not use any of the class of mechanical devices that ratchet, or break away, or snap into position—or whose operation is in any other way irreversible. Thus the steps described are very readily reversed to remove the circuit assembly (with the necessity of removing only the three trays and the rear panel/port); and with care indeed even the same assembly may be installed and removed several times.

Through use of the present invention the number of fasteners (screws) needed for installation of the printed-circuit assembly itself is only four. Two of these are passed through the two mounting holes 84, to self-tap into holes at the centers of the rear bosses 93. The two additional screws are used to fasten the Centronix® connector 98, as previously mentioned, into its sill 134 in the upturned back panel 35' of the base.

This total of four screws compares very favorably with the seven required when the front edge 82, too, of the circuit assembly is secured by screws passed through the reserved holes 85. Yet EMI control appears indistinguishable. A prior image-related or "multifunction" device required eleven screws to accomplish the same tasks now served by four, with the present invention in use.

In a device that offers poor access at both front and rear (or at both sides), installation of the circuit assembly can be accomplished generally as described for the preferred embodiment above—but with the unpinched edge 83 secured by alternative fasteners. Cams or other relatively expensive fastener types that do not require direct screwdriver access may be more readily justified when doing double duty for both edges of the circuit assembly, and when facilitating an otherwise desirable limited-access mounting geometry.

4. Some Specifications

For best control over performance of the invention, we prefer to observe these approximate conditions and parameters:

| | |
|---|---|
| circuit board | |
| peak tensile stress | 62 kPSI |
| bending modulus | 3.14 MPSI |
| Poisson's ratio | 0.155 |
| flexural strength | |
| in board plane | 78 kPSI |
| in long'l section | 60 kPSI |
| length | 8.2 inches |
| width | 5.6 inches |
| thickness | 0.062 inch |
| tolerance on same | ±0.007 inch |
| inset of holes from front edge | 0.38 inch |
| base | |
| radius of boss top | 0.25 inch |
| offsets of boss-hole centerlines to vertical retainer posts: | |
| transverse | 0.41 inch |
| longitudinal | 0.40 to 0.48 inch |
| vertical clearance (gap), top of boss to underside of retainer hook | 0.054 inch |
| tolerance on same | +0, −0.1 inch |
| inset of vertical retainer posts from rear wall | 5.66 inch |
| circuit assembly & base | |
| bend (flexure) of printed-circuit assembly, allowing all tolerances: | |
| minimum | 0.002 inch |
| maximum | 0.026 inch |

The above disclosure is intended as merely exemplary, and not to limit the scope of the invention—which is to be determined by reference to the appended claims.

What is claimed is:

1. A mounting system for a printed-circuit assembly in a desktop image-related device that operates at a high electronic frequency; said system comprising:

a chassis element for providing a path to ground from such printed-circuit assembly; and means, defined in the chassis element, for interacting with the printed-circuit assembly itself used as a lever, to forcibly pinch such printed-circuit assembly in a substantially normal direction of approach against the chassis element to provide an effective electrical ground, adjacent to the interacting means, without a separate fastener there for that purpose.

2. A mounting system for a printed-circuit assembly in a desktop image-related device that operates at a high electronic frequency, said printed-circuit assembly having first and second generally opposed edges; said system comprising:

a chassis element for providing a path to ground from such printed-circuit assembly;

means, defined in the chassis element near exclusively the first edge of the printed-circuit assembly, for forcibly engaging such printed-circuit assembly with the chassis element to provide an effective electrical ground, adjacent to the engaging means, without a separate fastener there for that purpose; and further comprising fastener means for securing such printed-circuit assembly, near exclusively its second edge, to the chassis element.

3. The mounting system of claim 2, wherein:

the engaging means comprise a pair of mechanical features for capturing exclusively the first edge of such printed-circuit assembly at installation; and the fastener means secure such printed-circuit assembly, near its second edge, in a position such that said mechanical features pinch exclusively the first edge of the printed-circuit assembly.

4. A mounting system for a printed-circuit assembly in a desktop image-related device that operates at a high electronic frequency, said printed-circuit assembly having first and second generally opposed edges; said system comprising:

a chassis element;

first raised means, defined in the chassis element, for supporting such printed-circuit assembly exclusively near its first edge;

retainer means, defined in the chassis element adjacent to the first raised means, for engaging and capturing exclusively the first edge of such printed-circuit assembly;

second raised means, defined in the chassis element, for supporting such printed-circuit assembly near its second edge; and fastener means for securing such printed-circuit assembly, near its second edge, to the chassis element.

5. The mounting system of claim 4, particularly for use in such an image-related device that is subject to mechanical shock loads during shipping and when moved within a home or office, and with such a printed-circuit assembly that includes a printed-circuit board; and wherein:

the retainer means are spaced vertically above the first raised means by a distance which is such as to place such printed-circuit board, when captured by the retainer means and secured by the fastener means, under very slight flexure.

6. The mounting system of claim 5, particularly for use with such printed-circuit board that has a thickness; and wherein:

said distance is very slightly smaller than the thickness of such printed-circuit board;

the chassis element has a substantially flat and broadly extended region; and the first and second raised means have substantially the same height, as measured parallel to said thickness and from said substantially flat and broadly extended region of the chassis element.

7. The mounting system of claim 5, wherein:

no separate fastener holds such printed-circuit assembly to the chassis element near the first raised means.

8. The mounting system of claim 4, wherein:

no separate fastener holds such printed-circuit assembly to the chassis element near the first raised means.

9. The mounting system of claim 4, particularly for use with such printed-circuit assembly that includes grounding pads formed on a surface of the assembly that faces said chassis element; and wherein:

said first raised means are metallic; and the metallic raised means engage the grounding pads.

10. The mounting system of claim 9, further comprising:

the chassis element is of formed metal.

11. The mounting system of claim 4, further comprising:

plural additional functional chassis modules and one or more casing elements, all structurally integrated with said chassis element.

12. The mounting system of claim 4, particularly for use with such printed-circuit assembly that includes grounding pads formed on a surface of the assembly that faces said chassis element; and wherein:

said second raised means are metallic; and the metallic raised means engage the grounding pads.

13. The mounting system of claim 4, particularly for use with such printed-circuit assembly that includes grounding pads formed on a surface of the assembly that faces said chassis element; and wherein:

said first raised means and said second raised means are metallic; and the metallic raised means engage the grounding pads.

14. A desktop image-related device that operates at a high electronic frequency and that is subject to mechanical shock loads during shipping and the like; said device comprising:

a printed-circuit assembly having first and second generally opposed edges;

a chassis element;

at least one first raised structure, defined in the chassis element, for supporting the printed-circuit assembly exclusively near its first edge;

at least one-retainer structure, defined in the chassis element adjacent to the first raised structure, for engaging and capturing exclusively the first edge of the printed-circuit assembly;

at least one-second raised structure, defined in the chassis element, for supporting the printed-circuit assembly near its second edge; and one or more fasteners for securing the printed-circuit assembly, near its second edge, to the chassis element.

15. The device of claim 14, further comprising:

plural additional chassis elements secured to said chassis element and obstructing access to at least some of said at least one retainer structure;

wherein said printed-circuit assembly is removable from the device without gaining access to the at least one retainer structure.

16. A desktop image-related device that operates at a high electronic frequency and that is subject to mechanical shock loads during shipping and the like; said device comprising:

a printed-circuit assembly having first and second generally opposed edges;

a chassis element;

at least one first raised structure, defined in the chassis element, for supporting the printed-circuit assembly near its first edge;

at least one retainer structure, defined in the chassis element adjacent to the first raised structure, for engaging and capturing the first edge of the printed-circuit assembly;

at least one second raised structure, defined in the chassis element, for supporting the printed-circuit assembly near its second edge; and one or more fasteners for securing the printed-circuit assembly, near its second edge, to the chassis element; and wherein:

said printed-circuit assembly is removable from the device by unfastening of the fasteners, angling the assembly out of engagement with the retainer structure, and shifting the assembly away from the retainer structure.

17. The device of claim 14, wherein:

no separate fastener holds such printed-circuit assembly to the chassis element near the at least one first raised structure.

18. The device of claim 17, wherein:

the printed-circuit assembly includes a printed-circuit board having a thickness;

the at least one retainer structure has a surface for engaging the top of such printed-circuit assembly; and said surface is spaced vertically above the at least one first raised structure by a distance which is such as to place such printed-circuit board, when captured by the at least one retainer structure and secured by the at least one fastener structure, under very slight flexure.

19. The device of claim 18, wherein:

said distance is very slightly smaller than the thickness of such printed-circuit board;

the chassis element has a substantially flat and broadly extended region; and the first and second at least one raised structure have substantially the same height, as measured parallel to said thickness and from said substantially flat and broadly extended region of the chassis element.

20. The device of claim 14, further comprising:

plural additional functional chassis elements and one or more casing elements structurally integrated with said chassis element.

21. A method of installing or removing a printed-circuit assembly that mounts within an image-related device which operates at a high electronic frequency; said printed-circuit assembly having a pair of generally opposed edges and said device having a chassis with retainers and raised features defined therein; and said method comprising the steps of:

inserting a first edge of the assembly between the retainers and a first group of the raised features;

then rotating the assembly into an operating position to:

engage the assembly with a second group of the raised features near a second edge of the assembly, and pinch the first edge of the assembly between the retainers and the first group of raised features; and then securing the assembly in said position; or reversing all of the foregoing steps to remove the assembly.

22. The method of claim 21, wherein:

said securing step comprises using exclusively mechanical fasteners and only near the second edge of the assembly.

23. A mounting arrangement for a printed-circuit assembly having a pair of spaced apart grounding pads disposed on an underside front edge portion thereof; the mounting arrangement comprising:

a chassis having a metallic base for providing an electrical grounding path for such printed-circuit assembly;

a front pair of spaced-apart boss members extending upward from said metallic base for supporting from below the underside front edge portion of such printed-circuit assembly; and a front pair of spaced-apart upstanding retainers extending upward from said metallic base for helping to align such printed-circuit assembly grounding pads with said boss members and for helping to sufficiently secure such printed-circuit assembly to said boss members to provide a completed electrical path from such grounding pads to said electrical grounding path;

wherein each individual one of said upstanding retainers extends upward from said metallic base a greater distance than each one of said boss members, to pinch such printed-circuit assembly and grounding pads between the retainers and the boss members, and thereby squeeze such grounding pads very firmly against the boss members.

24. The mounting arrangement of claim 23, wherein:

each of said boss members is generally conical in shape.

25. The mounting arrangement of claim 23, wherein:

each retainer is configured in an inverted "L" shape with its shorter leg forming a head extending rearward toward a vertical plane extending between said boss members.

26. The mounting arrangement of claim 25, wherein:

the pair of boss members is offset relative to the pair of retainers.

27. The mounting arrangement of claim 26, wherein:

said pair of boss members is offset, from the pair of retainers, about both horizontal and vertical axes.

28. The mounting arrangement of claim 27, wherein:

vertical spacing between the head of each retainer and the top of each boss member is substantially less than the thickness of such printed-circuit assembly along its front edge portion to provide an interference fit of a front edge portion of such printed-circuit assembly between the heads of the retainers and the tops of the boss members.

* * * * *